United States Patent [19]

Mosley, Jr.

[11] 4,423,895

[45] Jan. 3, 1984

[54] DEAD-BOLT-TYPE LOCKING MEANS, AND AN ASSEMBLY THEREOF

[76] Inventor: Thomas C. Mosley, Jr., 8628 E. Granada Rd., Scottsdale, Ariz. 85257

[21] Appl. No.: 256,388

[22] Filed: Apr. 22, 1981

[51] Int. Cl.[3] ..... E05C 1/06; E05C 9/02

[52] U.S. Cl. ..... 292/36; 292/37; 292/140; 292/148; 292/150

[58] Field of Search ..... 292/140, 34, 36, 37, 292/148, 150, 165, 169, 169.17, 57, 58

[56] References Cited

U.S. PATENT DOCUMENTS

| | | | |
|---|---|---|---|
| 1,144,289 | 6/1915 | Blair et al. | 292/140 |
| 1,427,253 | 8/1922 | Appleby | 292/140 |
| 1,681,856 | 8/1928 | Hunt | 292/36 |
| 2,035,074 | 3/1936 | Kauffman | 292/140 X |
| 2,088,665 | 8/1937 | Pinson | 292/37 |
| 2,592,647 | 4/1952 | Black | 292/218 |
| 3,298,728 | 1/1967 | Dye | 292/58 X |
| 4,229,956 | 10/1980 | Thorburn | 292/148 X |

FOREIGN PATENT DOCUMENTS

| | | | |
|---|---|---|---|
| 92253 | 10/1959 | Netherlands | 292/140 |

*Primary Examiner*—Gary L. Smith
*Assistant Examiner*—R. Illich

[57] ABSTRACT

In a first embodiment thereof, the locking means comprises an axially-translatable bolt slidably disposed within a cylinder. The cylinder has an axially-extended slot formed therein, and a pin fixed in the bolt projects therefrom, through the slot, to engage a camming slot formed in a sleeve which envelops the cylinder. A hollow cap-actuator envelops the camming-slotted sleeve, and a drive rib formed in the cap-actuator engages an axial separation in the sleeve to cause (a) the sleeve to rotate, when the cap-actuator is turned, (b) to cause the pin to travel along the camming slot, and (c) to effect extension and retraction of the bolt.

5 Claims, 8 Drawing Figures

DEAD-BOLT-TYPE LOCKING MEANS, AND AN ASSEMBLY THEREOF

This invention pertains to locking devices and systems, and in particular to such devices and systems of the dead-bolt type having a rigid bolt which is caused to extend and retract by means of a camming slot or the like. The prior art is replete with such devices and systems, and typical disclosures are found in U.S. Pat. No. 261,998, granted to W. C. Carson, on Aug. 1, 1882, for a "Sash Holder"; U.S. Pat. No. 316,282, issued to J. McCormick, on Apr. 21, 1885, also for a "Sash Holder"; U.S. Pat. No. 750,420, granted on Jan. 26, 1904, for a "Sash Fastener", to J. Anderson; and U.S. Pat. No. 1,144,289, given to J. C. Blair et al., also for a "Sash Fastener", on June 22, 1915.

The prior art devices, typically, have external or pendant bolts which travel along exposed tracks, or have external camming slots, the tracks and slots of which are subject to the collection of dirt and particulate matter. Most of the known devices require that the camming slot be formed in a barrel or cylinder, which is difficult and expensive of manufacture. Finally, many of the early devices have the camming slot formed in an element having a very limited diameter and, as a consequence, the slot must be of considerable circumferential length to effect any appreciable reciprocation of the bolt. Now, all the known locking devices are single-handed; that is to say, rotation of an actuator in one direction will extend the bolt, and reverse rotation will retract the bolt. No means are provided for reversing the actuation—so that the one direction will retract the bolt, and vice versa.

It is an object of this invention, then, to set forth an improved dead-bolt-type locking means, and an assembly of such means or devices, which are not met with the aforesaid limitations of the known devices.

It is particularly an object of this invention to disclose a dead-bolt-type locking means comprising a cylindrical element; a bolt slidably disposed within said element for axial translation relative to said element; a sleeve, having a camming surface, in envelopment of said element; an actuator in envelopment of said sleeve; and means fixed in said bolt, in penetration of said element, and cammingly engaged with said camming surface, for causing translation of said bolt in response to rotation of said sleeve; and wherein said actuator and said sleeve have means mutually cooperative to cause rotation of said sleeve in response to rotation of said actuator.

Further objects of this invention, as well as the novel features thereof, will become more apparent by reference to the following description, taken in conjunction with the accompanying figures, in which.

Figure 1:
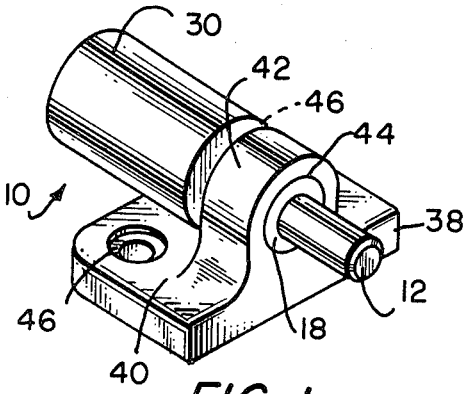
FIG. 1 is a perspective view of an embodiment of the novel locking means according to the invention.
Figure 3:
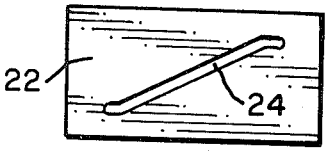
FIG. 3 is a plan view of the element which defines the camming sleeve prior to its arcuate or cylindrical formation and assembly into the locking means.

As shown in FIGS. 1–4, a first embodiment 10 of the novel locking means comprises a bolt 12 having a hole 14 formed therein, in a side thereof, which receives a drive pin 16. The bolt is slidably received in a cylinder 18, the latter having an axially-extended slot 20 formed therein within which to receive the pin 16. A camming sleeve 22, having a diagonal or spiral slot 24 formed therethrough, is fitted about the cylinder 18; the outermost end of the pin 16 is slidably engaged with the slot 24. The sleeve 22 does not describe a full circle and, consequently, it has an axially-extended separation 26. The separation nests with an axially-extended rib 28 formed in a cap-actuator 30 which envelops the sleeve 22. A snap ring 32 fits into mating grooves 34 and 36 formed in the cylinder 18 and cap-actuator 30, respectively, to hold all the components of the locking means in operative assembly.

As may be apparent from the figures, the locking means 10 is assembled as follows: the bolt 12 is slid into the cylinder 18; the camming sleeve 22 is slid into place over the cylinder; the hole 14, slot 20, and camming slot 24 are aligned, and the pin 16 is inserted therethrough into the bolt 12; the snap ring 32 is emplaced in the groove 34; and cap-actuator 30 is slid upon the sleeve 22; and then the cap-actuator is forced over the snap ring 32, until the latter sets in the groove 36.

A base 38, of generally right-angular configuration, has a platform 40 and an upstanding plate 42. The plate 42 has an aperture 44 formed therein of a dimension substantially conforming to the diameter of the cylinder 18. The latter is secured in the aperture 44 with an interference fit. Clearly, it would be optional to fix the cylinder in the plate 42 by means of a set screw, or the end of the cylinder and the wall of the aperture could be threaded. These are matters of incidental significance to the invention.

The base plateform 40 has mounting holes 46 formed therein by means of which the base 38 and the locking means 10 secured thereto can be fixed to a structure. As shown in FIG. 1, the bolt 12 is extended. When the cap-actuator 30 is turned in a counter-clockwise direction, the nesting of the separation 26 with the rib 28 causes the sleeve to rotate. Consequently, the drive pin 16 is forced to retract along the slot 24; this draws the pin along the slot 20 of the cylinder 18 and, consequently, the bolt 12 withdraws into the cylinder 18. Patently, to extend the bolt, it is necessary only to rotate the cap-actuator 30 in the clockwise direction.

Figure 2:
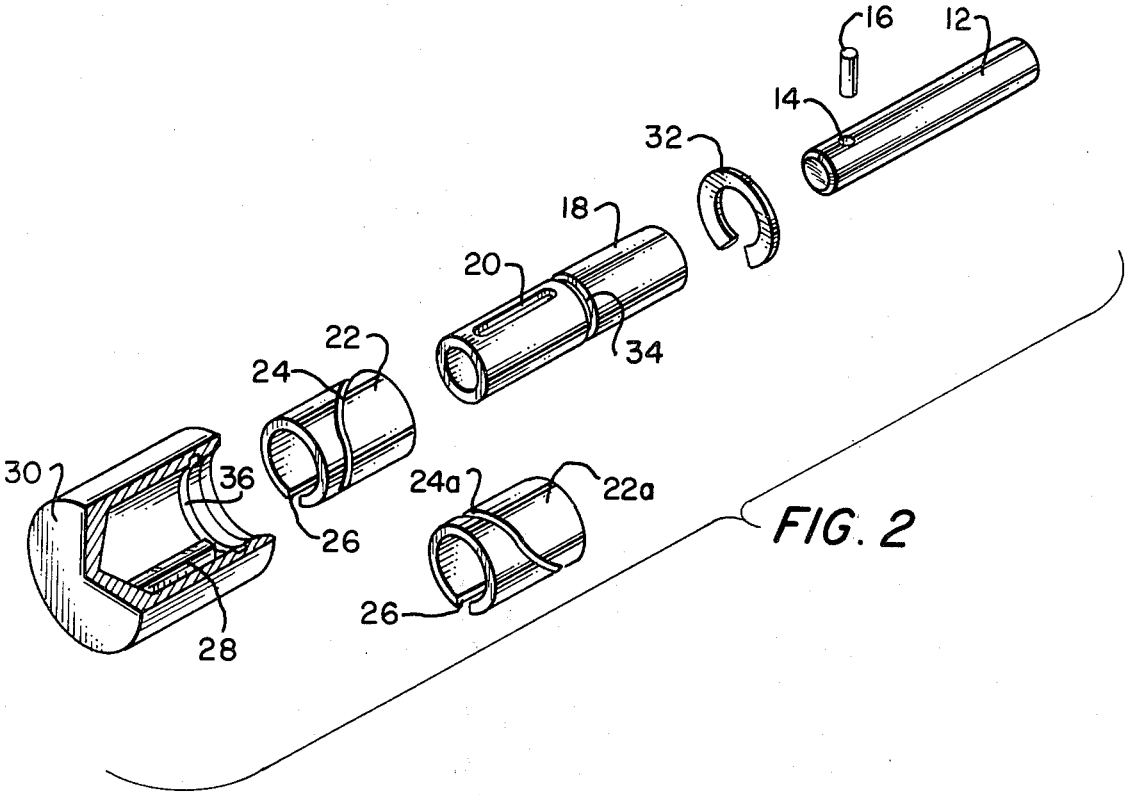
FIG. 2 is an exploded view of the embodiment of FIG. 1, the same showing an ancillary or substitute camming sleeve for opposite-handed operation of the locking means.
Figure 4:
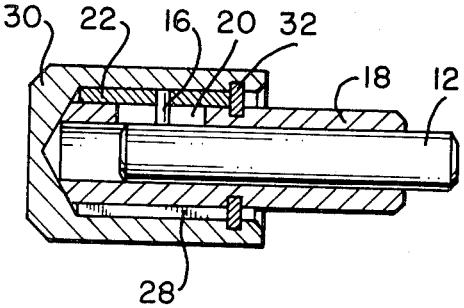
FIG. 4 is a cross-sectional view of the FIG. 1 embodiment, with the base excluded, taken along the axis thereof.

An ancillary or substitute camming sleeve **22*a* is shown in FIG. 2. Its purpose may well be quite evident. It may be used in place of camming sleeve 22 to cause the locking means 10 to be "other-handed", i.e., with camming sleeve 22*a* used in the assembly, the bolt 12 will extend when the cap-actuator is rotated in the counter-clockwise direction, and vice versa. This is so, of course, because the camming slot 24*a*** is set in the alternative direction.

The invention accommodates operation of the novel locking means from a remote area. To this end, the embodiment **10*a* of FIG. 5, has a modified cap-actuator 30*a*. The latter terminates in a hollow adapter 48 which receives an end of a rod 50; the latter is held in place by means of a set screw (not shown) fixed in a tapped hole 52 formed in the adapter 48**.

Figure 5:
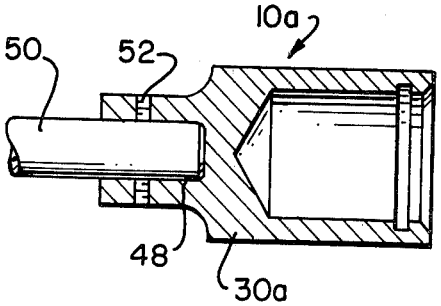
FIG. 5 is a fragmentary, cross-sectional view of an alternative embodiment of the invention, the same showing a remote-operation rod (portion) coupled to a modified cap-actuator.
Figure 7:
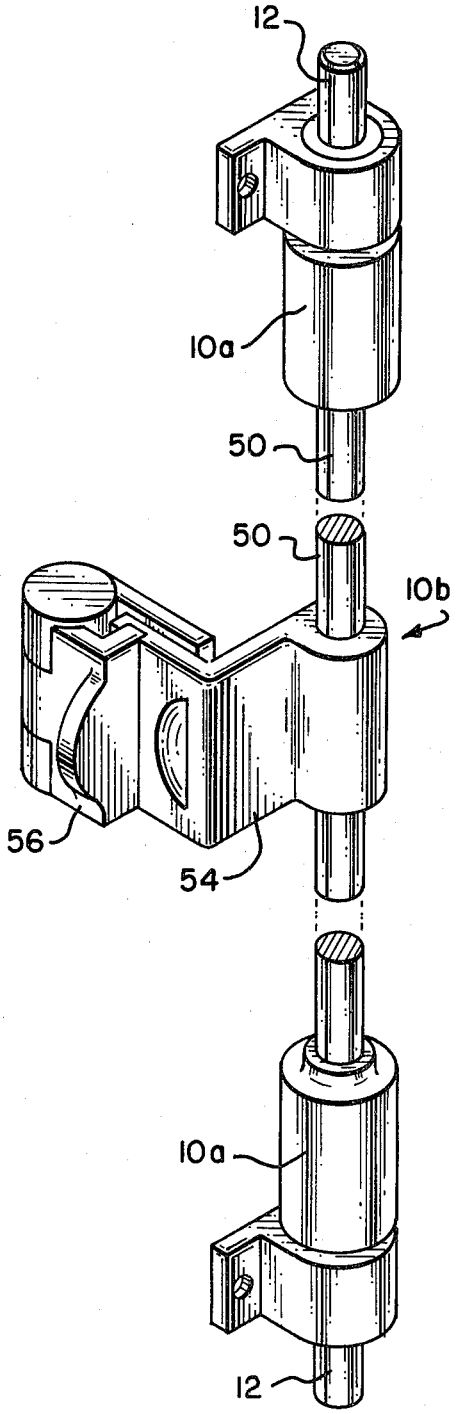
Figure 8:
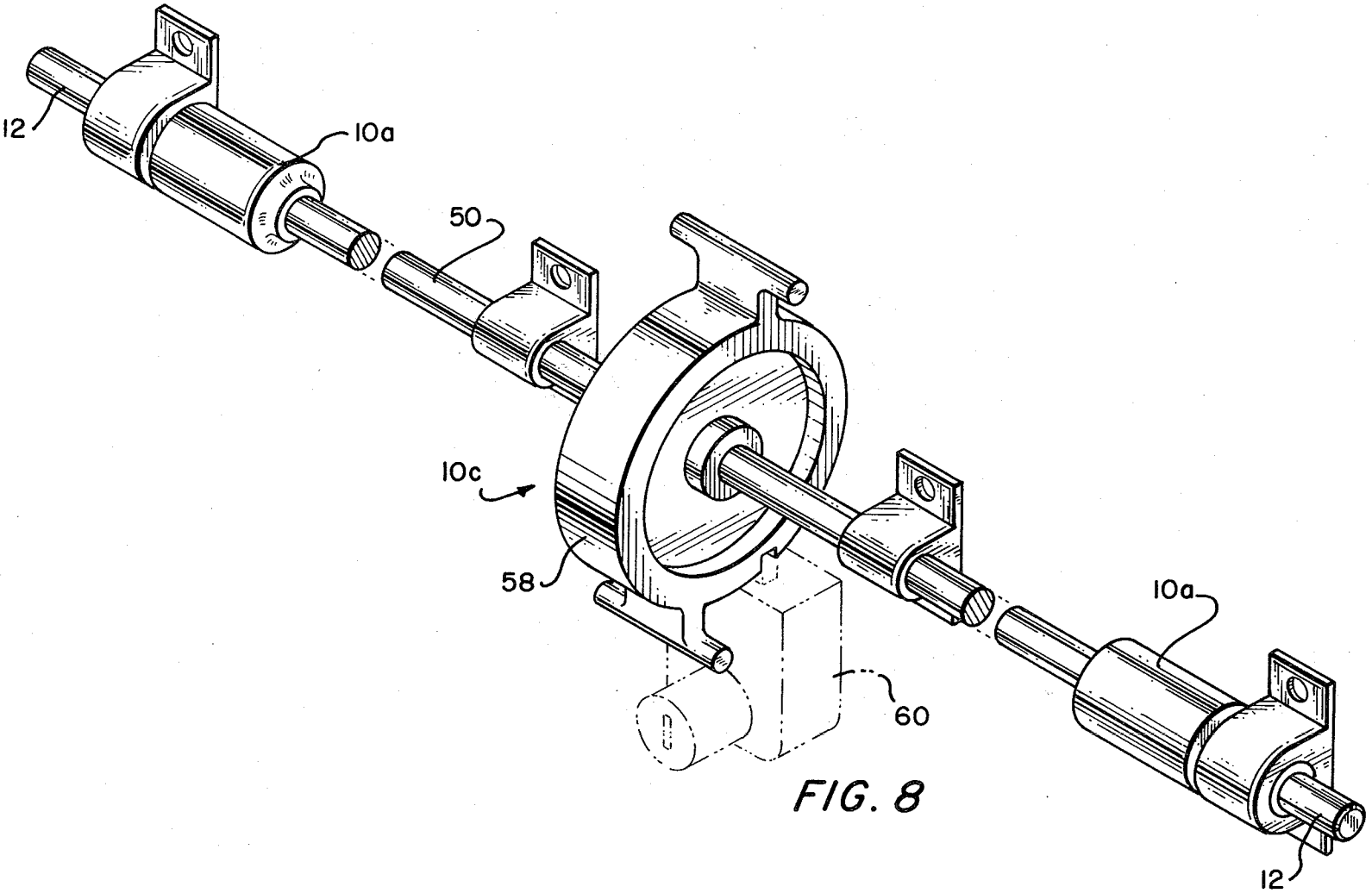

FIGS. 7 and 8 depict locking assemblies 10*b* and 10*c* which employ locking means such as that of the FIG. 5 embodiment. Here, of course, one of the locking means 10*a* of each assembly will be "right-handed" and the other "left-handed"; one will have a sleeve 22, and the other will have a sleeve 22*a*. Thus, as the rod 50, coupled to the pair of locking means 10*a*, is rotated in one direction, both bolts 12 will extend in unison, and contrary rotation of the rod will retract the bolts together.

The FIG. 7 assembly 10*b* has a limb 54 fixed to the rod 50 intermediate the length thereof, and a spring-loaded hinge-latch 56 receives an end of the limb 54 to hold the rod 50 against rotation. As shown, the bolts 12 of assembly 10*b* are extended, locking such structure to which it may be fixed, and the latch 56 hold the structure in the locked disposition.

Assembly 10*c*, of FIG. 8, has a hand-grip drum 58 coupled to the rod 50, for facile manipulation of the assembly, and a lock 60, shown only in phantom, is secured in immediate adjacency to the drum—for selectively locking the drum 58 against rotation.

As will be appreciated, assembly 10*b* will find application where it is desired to secure a sliding door or the like, and assembly 10*c* is especially useful for securing an overhead door or the equivalent.

Figure 6:
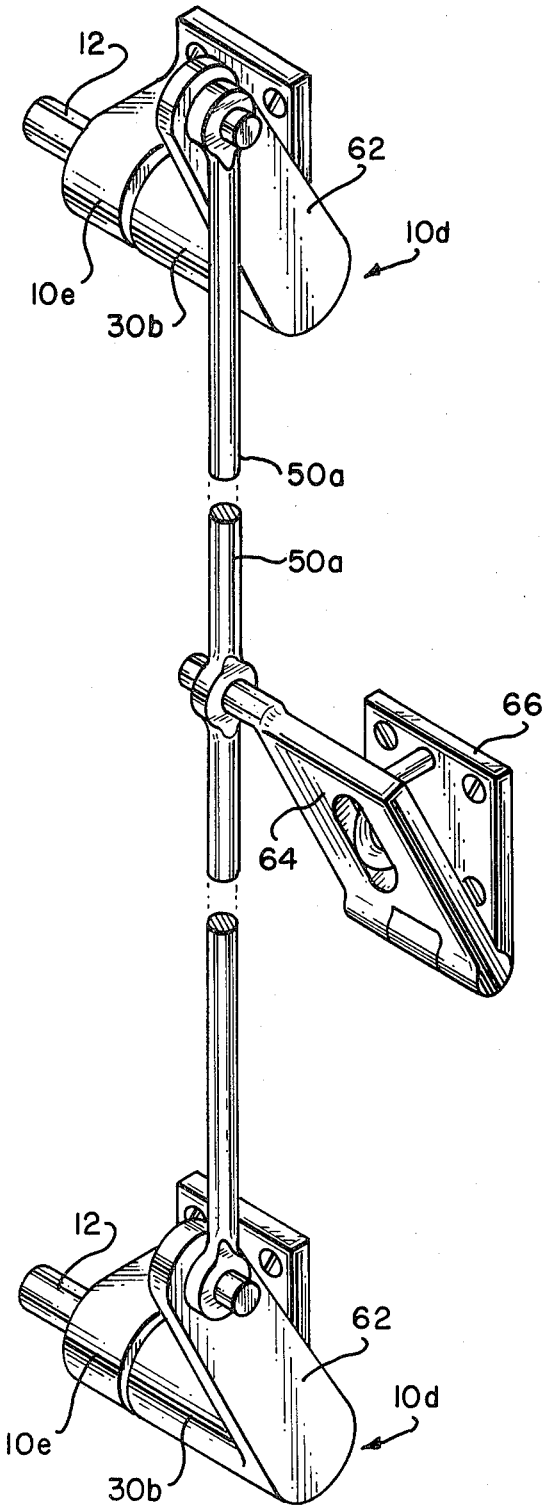
FIGS. 6, 7 and 8 are perspectives of further alternative embodiments of the invention, the same comprising locking assemblies.

The assembly 10*d* of FIG. 6 employs locking means 10*e* which are very much like embodiments 10, except that the cap-actuators 30*b* have crank arms 62 integral therewith. An actuating rod 50*a* is pivotably coupled at the ends thereof to each of the crank arms so that, as the rod 50*a* is moved up or down, the crank arms 62 move therewith, in unison. Intermediate the length thereof, the rod 50*a* is pivotally coupled to the outermost extension of a slotted hasp strap 64. The strap 64, as is conventional, is hinged to a plate 66 having normal thereto an apertured lug 68. The crank arms slue through arcs of a given radius, and the strap 64 also slues through an arc of the same, given radius. When the rod 50*a* is fully raised, the crank arms are disposed fully vertical, and the strap 64 is fully closed upon the plate 66. In this embodiment, of course, the locking means 10*e* both have sleeves 22; accordingly, both bolts 12 extend when the rod 50*a* is raised, and retract when the latter is lowered.

Assembly 10*d* has a particular utility for standard, vertical doors. This is not to say, however, that assembly 10*d* can not be used in other, suitable applications. Neither are the applications of any of the embodiments 10, 10*a*, 10*b*, 10*c*, or 10*d* exhausted by this disclosure. Others will find applications which meet their requirements. Further, while I have described my invention in connection with specific embodiments thereof, it is to be clearly understood that this is done only by way of example, and not as a limitation to the scope of my invention, as set forth in the objects thereof and in the appended claims.

I claim:

1. An assembly of dead-bolt-type locking means, comprising:

a plurality of dead-bolt-type locking devices;

each of said devices having (a) a cylindrical element;

(b) a bolt slidably disposed within said element for axial translation relative to said element;

(c) a sleeve, having a camming surface, in envelopment of said element;

(d) an actuator in envelopment of said sleeve; and (e) means engaged with said bolt, in penetration of said element, and cammingly engaged with said camming surface, for causing translation of said bolt in response to rotation of said sleeve; wherein said actuator and said sleeve have means mutually cooperative to cause rotation of said sleeve in response to rotation of said actuator; further including means coupled to said actuators of said devices for causing coincident rotation of each actuator pursuant to rotation of any one thereof; wherein said actuators of said devices each have a crank arm extending therefrom;

said coupled means comprises a rod coupled at the ends thereof to ends of said crank arms;

said rod is pivotably coupled to said ends of said crank arms; and said crank arms slue through arcs of a given radius; and further including a hasp coupled to said rod intermediate the length thereof;

said hasp including a pivoted and slotted strap, and an apertured lug for penetration of said slotted strap; wherein said strap slues through an arc of said given radius; and a radially outermost portion of said strap is pivotably coupled to said rod.

2. A locking means, according to claim 1, wherein:

said cylindrical element has an axially extended slot formed therein; and said means engaged with said bolt comprises a pin extending from said bolt normal thereto, said pin being in traverse of said slot.

3. A locking means, according to claim 2, wherein:

said sleeve has a camming slot formed therein, which defines said camming surface; and an end of said pin is slidably engaged with said camming slot in said sleeve.

4. A locking means, according to claim 1, wherein:

said sleeve, circumferentially thereof, has a discontinuity; and said actuator has a prominence formed thereon, extending centrally thereof, engaged with said discontinuity;

said prominence and said discontinuity defining said mutually cooperative means for causing rotation of said sleeve in response to actuator rotation.

5. An assembly, according to claim 1, wherein:

said sleeve of one of said devices has a camming surface which describes a substantially diagonal path, relative to the axis of said element, in a prescribed direction; and said sleeve of another of said devices has a camming surface which describes a substantially diagonal path, relative to the axis of said element, in a direction which traverses said prescribed direction.

* * * * *